United States Patent [19]

Schaefer

[11] 4,024,647

[45] May 24, 1977

[54] TEMPERATURE CONTROLLED HEATER TRAY

[75] Inventor: William L. Schaefer, Gibsonia, Pa.

[73] Assignee: PPG Industries, Inc., Pittsburgh, Pa.

[22] Filed: Jan. 20, 1976

[21] Appl. No.: 650,817

[52] U.S. Cl. ..... 34/12; 65/21; 219/388; 432/134

[51] Int. Cl.[2] ..... F26B 7/00

[58] Field of Search ..... 34/1; 432/134; 236/15 BR, 15 BC; 13/34; 219/388 R, 388 C; 65/21

[56] References Cited

UNITED STATES PATENTS

| | | | |
|---|---|---|---|
| 2,539,916 | 1/1951 | Ludington et al. | 65/21 |
| 3,096,161 | 7/1963 | Morrison et al. | 34/1 |
| 3,259,995 | 7/1966 | Powischill | 236/15 BC |
| 3,365,182 | 1/1968 | Ipsen | 432/134 |
| 3,462,078 | 8/1969 | Houchman | 236/15 BC |
| 3,555,693 | 1/1971 | Futer | 34/1 |
| 3,939,326 | 2/1976 | Hutner | 219/388 |

*Primary Examiner*—John J. Camby

*Attorney, Agent, or Firm*—Alan T. McDonald; John E. Curley

[57] ABSTRACT

A method and apparatus is disclosed for drying and conveying chopped glass strands. The system includes apparatus for controlling the temperature of the conveying means to thereby control the drying of the wet chopped glass strand and to avoid overheating of the glass strand.

5 Claims, 4 Drawing Figures

TEMPERATURE CONTROLLED HEATER TRAY

BACKGROUND OF THE INVENTION

Chopped glass fiber strand is a known useful product for such uses as reinforcement of plastics. It is known to chop glass fiber strand directly as it is being attenuated from a fiber forming bushing. In U.S. Pat. No. 3,869,268, which is incorporated herein by reference, glass filaments are attenuated from a bushing. The filaments are coated with a lubricant binder and/or size as they are attenuated and are gathered by a gathering shoe into one or more unified strands. The unified strands so formed are chopped between a pair of rollers, one of which contains cutting blades and the other of which is used as a backup roller. The resulting chopped strand is conveyed along a pair of vibrating trays under a heater to dry the wet chopped strand. It has been found that with some lubricant binders and/or sizes that, due to heat sinks formed by the reinforcement ribs and vibrator connections under the second vibratory tray, sticking of the chopped strand to the tray often occurs.

In copending U.S. patent application Ser. No 638,481 filed Dec. 8, 1975, assigned to the assignee of the present invention and which is incorporated herein by reference, an insulated vibratory tray is disclosed which comprises a pair of sections having their only connection at their outer lips and being spaced from each other such that an insulating air space between the sections is maintained. The reinforcing ribs are connected to the lower section thus eliminating any heat sinks from the upper conveying section across which the glass strand travels.

With the development of the insulated tray a new problem has arisen. The heaters employed to dry the chopped strand supply enough heat to heat the vibratory tray to a point where no sticking occurs and to dry the chopped glass strand. The heater is operated at a constant, pre-set level is sufficient to both heat the tray and to dry the chopped glass strand.

The system operates sufficiently when a continuous film of glass strand across the tray is maintained. This is, of course, the most desirable way to operate the system. However, it is not always possible to continuously operate the system. For example, break outs of the glass fiber strands will occur for numerous reasons, such as a flooding of the bushing requiring a shut down until the problem is rectified. When the continuous operation is interrupted, no chopped glass strand will be traveling along the conveyor. When this occurs, no heat is required to dry chopped glass strand. This heat is, however, being supplied by the heaters, since they have been pre-set to a specific output level. Much of this unused heat will be absorbed by the conveyor thus increasing its temperature above that which is desired. When resumption of flow of the glass strand occurs, the extra heat causes the binder and/or size to become overcured thus resulting in unacceptable products.

It is desirable, therefore, to be able to control the temperature of the conveyor such that its temperature is not permitted to rise above a certain level even when the flow of glass strand is interrupted.

THE PRESENT INVENTION

By means of the present invention, such control of the conveying tray is now possible. A temperature sensitive element, such as a thermocouple, is connected to a point along the underside of the upper section of the sectioned vibratory tray located under a heater. The temperature sensitive element feeds temperature information to a temperature controller which has been pre-set to a desired temperature for that point of the conveyor. Upon receiving this temperature information, the temperature controller signals a means for allowing current to pass to the heaters. This current control mechanism increases or decreases the amount of current allowed to flow to the heater to maintain the proper temperature on the conveyor, thus avoiding overheating of the chopped glass strands.

DETAILED DESCRIPTION OF THE DRAWINGS

Figures 1, 2:
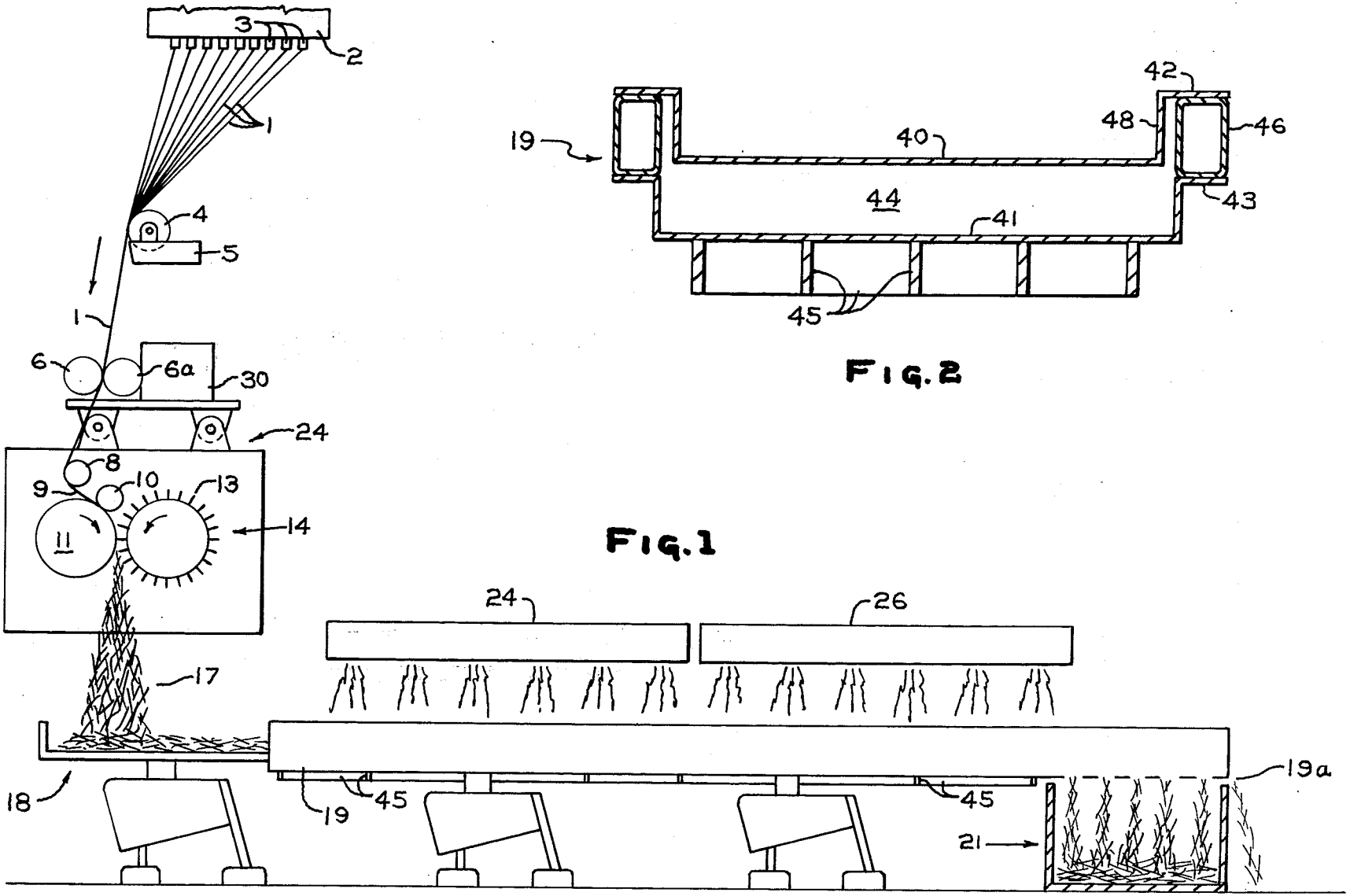
FIG. 1 is a diagrammatic representation of the method and apparatus for chopping glass strand according to the present invention.
FIG. 2 is a cross-sectional view of the vibratory tray employed in the present invention.

Referring now to FIG. 1, glass filaments 1 are attenuated from tips or orifices 3 in a bushing 2. The fibers 1 are coated with a lubricant binder and/or size prior to contacting each other to prevent damage to the filaments cured by filaments abrading against each other. The lubricant composition is applied by passing filaments 1 over an applicator 4 which may be a roller applicator, belt applicator, or the like which is immersed in a bath 5 of the lubricant composition. The bath 5 is usually fed by pumping the lubricant composition from a hold tank, not shown, to the bath 5.

The filaments 1 are passed through a pair of start-up rolls or pull rolls 6 and 6*a* which attenuate the fibers 1 at a low speed to begin the fiber forming process. While the pull rolls 6 and 6*a* are in operation, glass fibers being formed are disposed of by means of a waste chute, not shown in FIG. 1. At this point in the operation, no chopped glass strand is being supplied to the vibratory conveyor 19. When the process is begun, glass fibers 1 being formed are placed through a guide or gathering shoe 8, which is generally a grooved cylinder, which gathers the filaments 1 together and forms them into one or more strands. The gathering shoe 8 traverses through a small distance of travel across the face of wheel 11 by a traversing means not shown in FIG. 1.

The strands 9 are passed through a free wheeling feed roll 10 which aligns the strands 9 for the cutting action. The feed roll 10 has a knurled surface to provide tractive force between the strands 9 and the roll 10.

Feed roll 10 is in contact with a cot roll or backup roll 11. Having the strand 9 in contact with both rolls 10 and 11 provides the attenuation necessary to form fibers 1. Generally the fibers 1 are attenuated at speeds of about 2,000 to 3,000 feet per minute (609.6 to 914.4 meters) per minute or more.

The strand 9 is passed between the cot roll 11 and the cutting blades 13. The cutting blades 13 are mounted in grooves on the cutter head 14, said head having a plurality of grooves, not shown in FIG. 1, oriented traversely and obliquely to the axis of the cutter head 14.

Thus, the strands 9 are formed in the traversing gathering shoe 8 and are attenuated by a feed roll 10 contacting cot roll 11 with the strand 9 pulled between the rolls 10 and 11. The strand 9 is then chopped by the blades 13 while contacting the cot roll 11.

The chopped strand 17 then falls onto a first vibratory conveyor 18, which agitates the wet chopped strand 17 which typically has a moisture content from about 9 to 11 percent by weight due to the aqueous size previously applied. The vibratory action maintains the chopped strands 17 in discrete glass fiber bundles rather than having the bundles adhering to each other.

The chopped strand 17 is passed from the vibratory conveyor 18 to a second vibratory conveyor 19 having an amplitude of vibration less than the first vibratory conveyor 18. Associated with the second vibratory conveyor 19 is a heating zone, in this case a pair of infrared heaters 24 and 26. In practice, each heater 24 and 26 contains two infrared elements, not shown. As the chopped strand 17 is conveyed along the second conveyor 19, it is reduced in moisture content to less than 0.1 percent by weight by the applied heat. Means other than the infrared heaters 24 and 26 may be used to supply the heat for moisture reduction, such as a forced air oven or the like, as long as the heater employed may be controlled by electrical current allowed to pass thereto. The portion 19*a* of the second conveyor 19 is foraminous in order that proper length dried chopped strand 17 must fall through the apertures in the conveyor and into a collection package 21. Oversized material is removed at the end of the conveyor.

Referring now to FIG. 2, the second vibratory conveyor or tray 19 is shown in cross-section. As can be seen in this Figure, the tray 19 comprises two sections 40 and 41. Between these two sections 40 and 41 along their lengths is an air space 44. The lips 42 of the upper tray 40 and the lips 43 of the lower tray 41 have spacers 46 therebetween. These spacers provide the requisite air space between the two sections. The spacers 46 are the only connection between the two sections 40 and 41. The spacers 46 are formed of ceramic, metal, or the like. They are spaced from the side 48 of the upper tray to prevent heat conduction through the spacer 46. Under the second section 41 are a series of reinforcing ribs 45. The air space 44 insulates the upper section 40 from the insulating ribs 45 attached at the lower section 41. The air space between the upper section and the lower section is preferably about 1.25 inches (3.18 centimeters).

Figure 3:
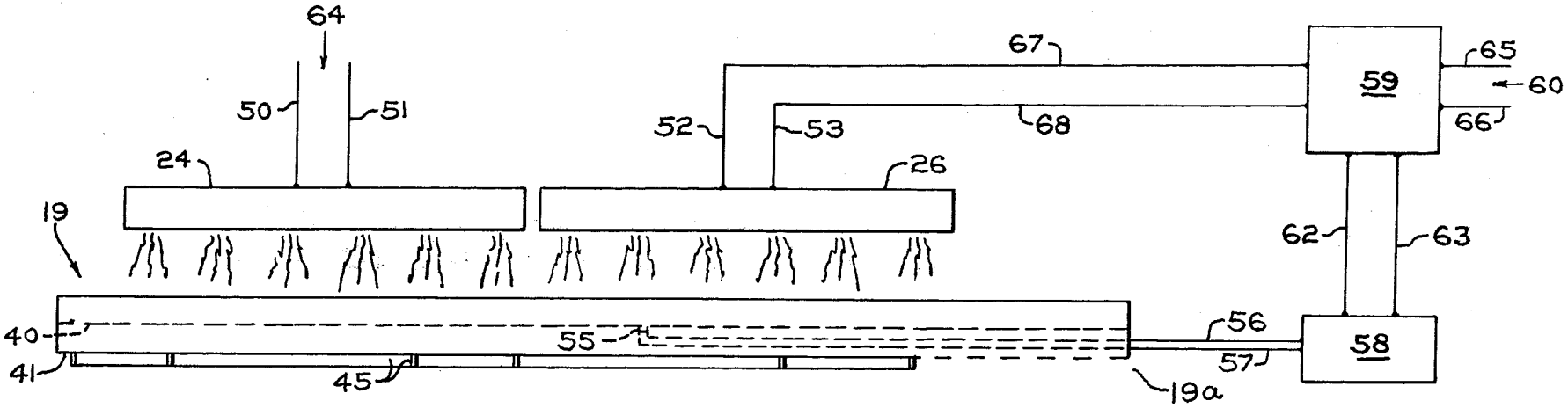
FIG. 3 is a diagrammatic representation of the method and apparatus of heating the vibratory tray according to the present invention.

Referring now to FIG. 3, the preferred apparatus and method for controlling the temperature of the vibratory tray 19 is illustrated. Thermally connected at a point along the upper section 40 of the tray 19 is a temperature sensitive element 55, such as a thermocouple. The temperature sensitive element 55 senses the temperature of the upper section 40 of the vibratory conveyor 19 at the point above the thermocouple. This is the section over which the chopped glass strand passes. The temperature sensitive element 55 relays this temperature information through electrical lines 56 and 57 to a temperature controller 58 which monitors the temperature continuously. This controller 58 has been pre-set to a desired temperature for this point of the upper section 40 of the vibratory conveyor 19. Upon receiving this temperature information, the temperature controller 58 sends an electrical signal to a power controller 59 through lines 62 and 63. The power controller receives incoming power through lines 65 and 66 from power source 60, such as a 480 volt 60 cycle alternating current.

In response to the signal received from the temperature controller 58, the power controller 59 increases or decreases the amount of power ouput to its output lines 67 and 68. The power controller is a standard alternating current controller which, upon receiving its signal from the temperature controller allows none, some, or all waves of the alternating current to pass to the heater. In order that the output be smooth, any subtraction of current from the 60 cycle aternating input is accomplished by removing complete sine waves by means well-known in the electrical arts. A typical type current controller is a Chromalox type CSCR power controller, such as a CSCR-14, and the specific temperature controller employed is a Chromalox CFEI 74.

In the preferred embodiment, the output lines 67 and 68 are connected to a heater element 26, such as an infrared heater as previously described, through lines 52 and 53. At the same time, heater 24 is separately receiving power through lines 50 and 51 from power source 64 such as a 480 volt 60 cycle alternating current. It is not always necessary to control the power supplied to the heater 24. The cold, wet glass strand 17 entering the second vibratory tray 19 will not easily be overheated and thus not overcured at a higher temperature than normally occurs at the beginning of the tray. As the glass strand 17 moves along the tray 19, however, if the temperature of the tray remains at a higher than desired level, this can cause overheating and overcuring of the glass strand.

Figure 4:
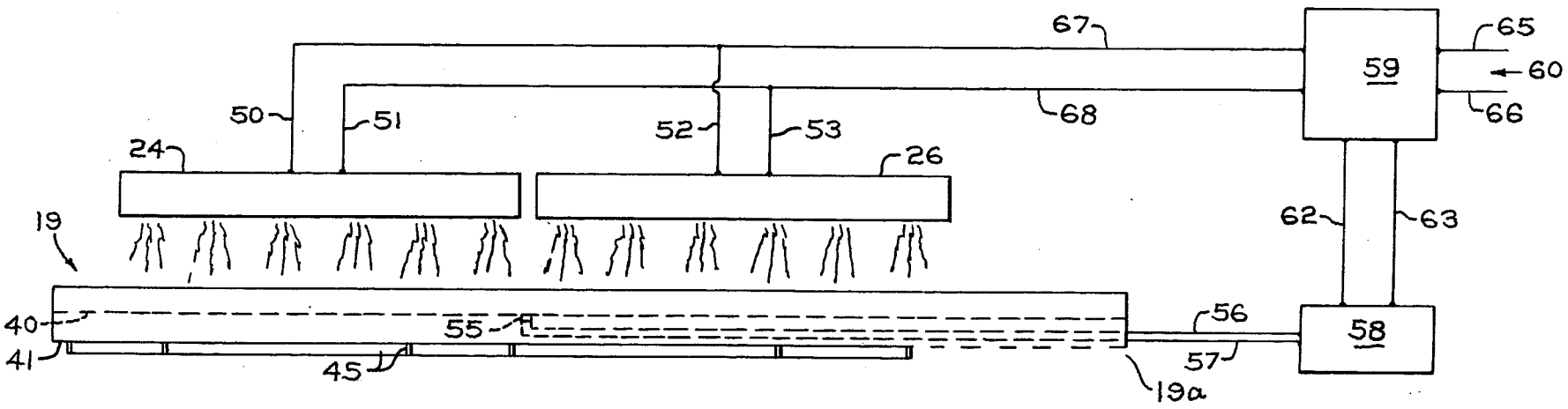
FIG. 4 represents an alternative method of heating the vibratory tray according to the present invention.

Referring now to FIG. 4, an alternative embodiment of the present invention is shown. In this Figure, both heaters 24 and 26 have their input power controlled by the power controller 59. In this embodiment, input lines 50 and 51 for heater 24 and 52 and 53 for heater 26 are connected in parallel with the output lines 67 and 68 of the power controller.

While in the preferred embodiment a pair of infrared heaters has been illustrated at the heating mechanism, it should be obvious that other heaters may be employed in the present invention.

Further, it should be obvious that a single heater having its input power controlled or that three or more heaters, some or all of which having their input power controlled, may be employed in the present invention.

EXAMPLE

Using the chopping apparatus as shown in FIG. 1 and the heater control mechanism shown in FIG. 3, K-6.75 glass strand was attenuated at a speed of 2,500 feet per minute (762 meters) per minute and chopped into fibers having a length of 0.125 inch (0.318 centimeter). The air space 44 between sections 40 and 41 of the tray 19 was 1.25 inch (3.18 centimeter). The temperature near the center of the upper section 41 of the tray 19 was controlled to approximately 200° F. (93.3° C.). The input power to the heaters 24 and 26 was controlled from a 480 volt 60 cycle alternating current source by a Chromalox CSCR-14 power controller and a Chromalox CFEI 74 temperature controller. No overcured glass strand was observed during a run of 168 hours.

While the present invention has been described with reference to specific embodiments thereof, it is not intended to be so limited except insofar as in the appended claims.

I claim:

1. In the method of drying wet chopped glass strand having a binder thereon which may be overheated and overcured comprising passing said strand along a first vibrating conveyor having no heaters located thereabove, passing said strand along a second, heated, insulated vibrating conveyor having at least two heaters located thereabove and heating the wet chopped glass strand to thereby dry it, the improvement comprising maintaining sufficient heat output from at least one of said heaters in response to temperature fluctuations of said second conveyor to dry and cure said wet chopped glass strand while preventing overheatng and overcuring of said wet chopped glass strand during said drying.

2. The method of claim 1 wherein said heaters are infrared heaters.

3. The method of claim 1 wherein at least one of said heaters does not have its heat output controlled.

4. The method of claim 1 including selecting a predetermined operating temperature for a point along said second conveyor and continuously monitoring the temperature of this point.

5. The method of claim 4 including adjusting the power input to at least one heater based upon fluctuations in the temperature at said point along the second conveyor.

* * * * *